US007916887B2

(12) United States Patent
Cleckler et al.

(10) Patent No.: US 7,916,887 B2
(45) Date of Patent: Mar. 29, 2011

(54) WIND-SHIELDED ACOUSTIC SENSOR

(75) Inventors: Jay Cleckler, Long Beach, CA (US); Scott Paul Catanzariti, Huntington Beach, CA (US); Gabriel Hiu Tse, Newport Coast, CA (US); John Shigenori Hirai, Costa Mesa, CA (US); Raymond Charles Law, Anahiem, CA (US)

(73) Assignee: Scientific Applications and Research Associates, Inc., Cypress, CA (US)

( * ) Notice: Subject to any disclaimer, the term of this patent is extended or adjusted under 35 U.S.C. 154(b) by 1279 days.

(21) Appl. No.: 11/035,367

(22) Filed: Jan. 13, 2005

(65) Prior Publication Data

US 2005/0169489 A1 Aug. 4, 2005

Related U.S. Application Data

(60) Provisional application No. 60/540,058, filed on Jan. 30, 2004.

(51) Int. Cl.
*H04R 25/00* (2006.01)

(52) U.S. Cl. ..... 381/359; 381/360; 381/189

(58) Field of Classification Search ..... 381/355–362, 381/365, 367, 368, 122, 71.1, 91, 363; 181/158, 181/242; 367/104, 120, 901
See application file for complete search history.

(56) References Cited

U.S. PATENT DOCUMENTS

| | | | | |
|---|---|---|---|---|
| 3,895,188 | A * | 7/1975 | Ingraham | 381/160 |
| 4,570,746 | A * | 2/1986 | Das et al. | 381/359 |
| 4,966,252 | A * | 10/1990 | Drever | 181/158 |
| 5,329,593 | A * | 7/1994 | Lazzeroni et al. | 381/357 |
| 5,808,243 | A * | 9/1998 | McCormick et al. | 181/0.5 |
| 6,682,043 | B1 * | 1/2004 | Hsieh | 248/638 |

FOREIGN PATENT DOCUMENTS

WO WO 95/31083 11/1995

OTHER PUBLICATIONS

Allen, Christopher S. et al., Aeroacoustic Probe Design for Microphone to Reduce Flow Induced Self Noise, 1993, NASA Ames Research Center, Moffett Field, California.

Morgan, Michael S., An Investigation of the Sources and Attenuation of Wind Noise in Measurement Microphones, 1993, UMI Dissertation Services.

* cited by examiner

*Primary Examiner* — Huyen D Le

(74) *Attorney, Agent, or Firm* — Stetina Brunda Garred & Brucker

(57) ABSTRACT

A wind-shielded acoustic sensor, having a microphone and a housing of the microphone. The housing has a streamlined, continuous profile about a latitudinal axis and a longitudinal axis thereof, such that wind-induced noise can be reduced. A plurality of uniformly spaced sound ports are formed along a plurality of circumferences centered about a longitudinal axis thereof. At least one region of the housing is sufficiently thin and pliable such that deformation will occur while subjected to wind. Thereby, both acoustic signals and wind-related random-like pressure fluctuations are transmitted into the cavity enclosed by the housing.

19 Claims, 3 Drawing Sheets

WIND-SHIELDED ACOUSTIC SENSOR

CROSS-REFERENCE TO RELATED APPLICATIONS

This application claims priority to Provisional Patent Application Ser. No. 60/540,058, filed Jan. 30, 2004, entitled WIND-SHIELDED ACOUSTIC SENSOR, the teachings of which are expressly incorporated herein by reference.

STATEMENT RE: FEDERALLY SPONSORED RESEARCH/DEVELOPMENT

Not Applicable

BACKGROUND OF THE INVENTION

The present invention relates in general to an acoustic sensor, and more particularly, to an acoustic sensor used in windy environments found on aircraft, moving ground vehicles, wind tunnels and in naturally windy conditions.

Signal detection afforded by acoustic sensors or microphones are limited in windy conditions by at least two distinct forms of wind-induced noise. The first form is due to disturbances in the wind created by the acoustic sensor, which is solely caused by interaction of the wind and the aerodynamics of the sensor and/or sensor windscreen. The second form of wind-induced noise involves complex velocity and pressure fluctuations that are an inherent component of most wind.

The solution of the first form of wind-induced noise is proper aerodynamics. Proper aerodynamics design seeks to minimally disturb the wind, avoid separation of flow from the surface of the windscreen and thereby prevent unsteady, noisy flow from developing. Various distinct design techniques have been proposed for achieving proper aerodynamics. However, the low-noise achievement of these design techniques has been limited to the condition that winds are approaching in a given direction. That is, when winds alter their course, the low-noise performance of these aerodynamic design techniques is negated.

The second form of wind-induced noise caused by complex velocity and pressure fluctuations inherent to most winds is more difficult to address. Currently, foams, fabrics and other porous materials have been used to lessen the effects of these natural fluctuations on the acoustic sensors. The most common of these techniques is the use of an open cell, reticulated foam ball. However, all such approaches only offer limited immunity to inherent wind fluctuations, and are not sufficiently rugged for many applications.

BRIEF SUMMARY OF THE INVENTION

A wind-shielded acoustic sensor is provided to effectively reduce both categories of wind induced noises. The acoustic sensor has a microphone housing that employs an aerodynamic cross-section operative to redirect the bulk fluid flow around the sensing elements while causing minimal disturbance to the fluid flow. The housing may be formed in many different shapes, but the preferred embodiment is symmetrical (like a disc) or nearly-symmetrical about an axis, allowing the windscreen to present a similar aspect to the fluid flow for many given flow directions. In addition, separate sound ports and/or structural components that are semi-transparent to sound are formed to capture both the sound signal to be measured and the random-like pressure fluctuations that may be inherent in winds. The sound ports bring the detected signal and pressure fluctuations into a central mixing cavity, which serves to remove the random-like pressure fluctuations through a process of uncorrelated averaging and intensify the detected signal, which, by contrast, is well correlated.

The housing includes sufficiently thin and pliable regions that will deform subject to wind. In addition, sound ports are formed to extend through the housing. The deformation of the housing regions and the sound ports allow sounds, including the acoustic signals and wind-related, random-like pressure fluctuations, to transmit through the housing and enter the cavity enclosed by the housing. Addition of the acoustic signals and the wind-related, random-like pressure fluctuations occurs within the cavity. As the negative components and the positive components of the wind-related, random-like pressure are substantially equal, the addition thus substantially removes wind-related, random-like pressure. The microphone can thus detect the acoustic signals with greatly reduced wind noise. The acoustic sensor may be secured to the ground or a flat surface by gripping the housing from two adjacent edges or by inserting a rigid shaft into the center of the housing along the longitudinal axis.

In one embodiment, the housing may further comprise a streamlined surface extending from the circular disc to a mounting unit. The mounting unit as well as the housing can be supported by a mating shaft connected to a perpendicular shaft. To avoid vibration, a cross shaft may also be affixed to the mating shaft and the perpendicular shaft diagonally. It is also contemplated that alternative mounting arrangements may be utilized as may be appropriate for a given application of the sensor.

BRIEF DESCRIPTION OF THE DRAWINGS

These as well as other features of the present invention will become more apparent upon reference to the drawings therein.

DETAILED DESCRIPTION OF THE INVENTION

Figure 1:
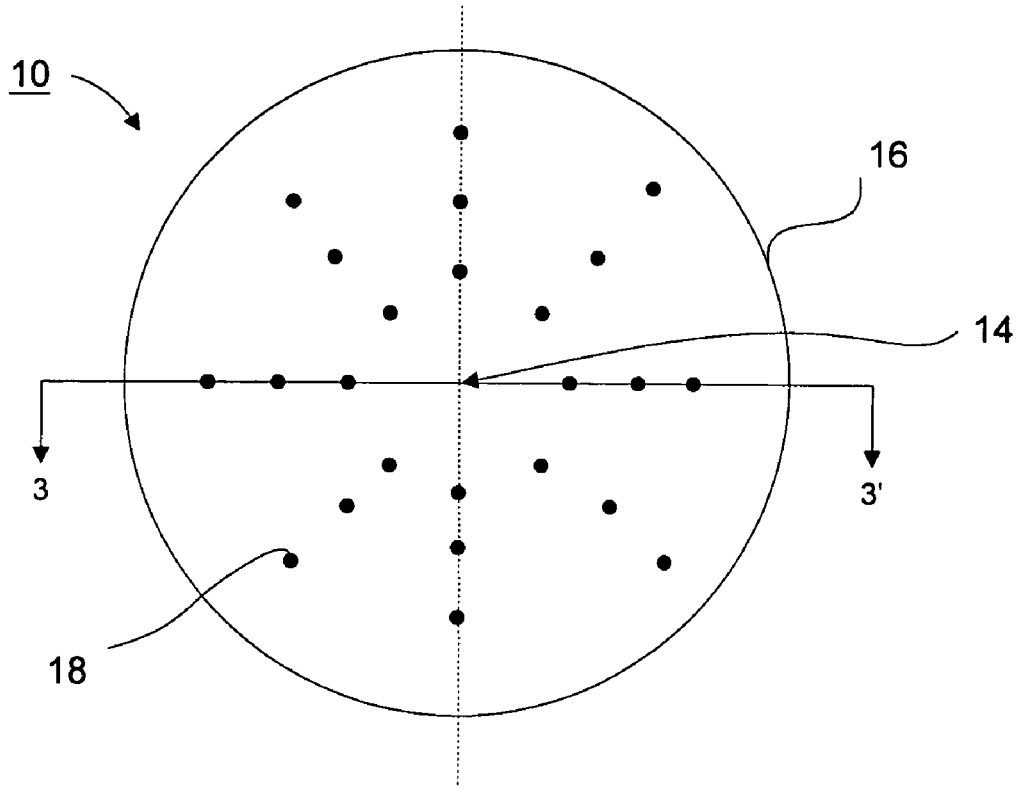
FIG. 1 is a top view of a wind-shielded acoustic sensor comprising a microphone housing.
Figure 2:
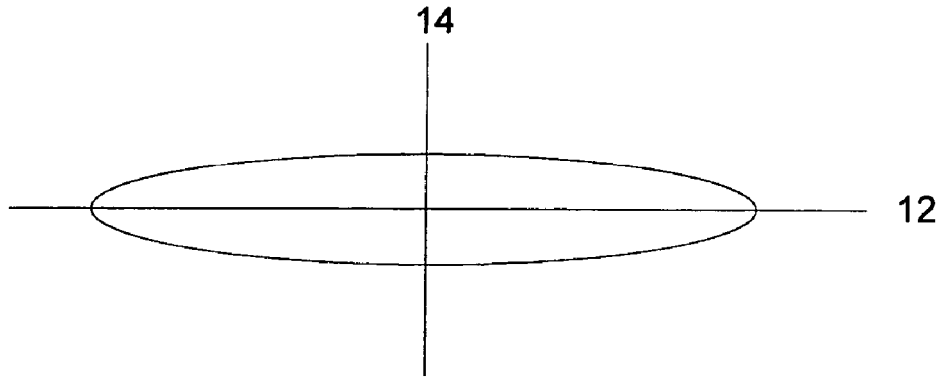
FIG. 2 is a side view of the wind-shielded acoustic sensor as shown in FIG. 1.
Figure 3:
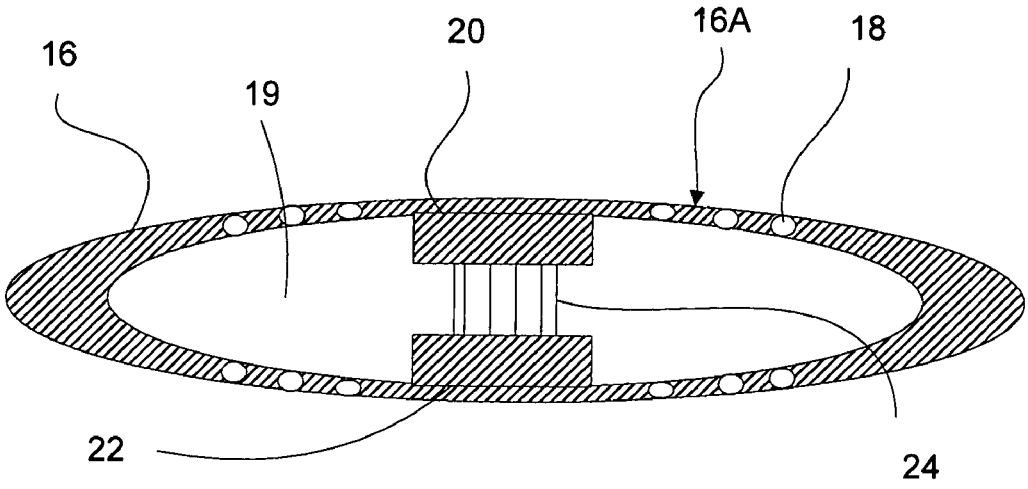
FIG. 3 is a cross-sectional view of the wind-shielded acoustic sensor as shown in FIG. 1.

Referring now to the drawings wherein the showings are for purpose of illustrating preferred embodiments of the present invention only, and not for purposes of limiting the same, FIG. 1 shows a top view of an embodiment of a wind-shield acoustic sensor 10, FIG. 2 shows a side view of the acoustic sensor 10, and FIG. 3 shows a cross-sectional view of the acoustic sensor 10 along line 3-3'. As shown, the acoustic sensor 10 includes a housing 16 having a streamline, aerodynamic profile that is everywhere continuous and symmetric about a latitudinal axis 12. In this embodiment, the profile is in the form of a circular disc that is also symmetric about a longitudinal axis 14 thereof. With the streamlined and symmetric profile, the housing 16 can be oriented such that wind may flow along any direction roughly perpendicular to the longitudinal axis 14, which itself is made to be perpendicular to the ground or the mounting surface. The profile thus prevents the creation of unnecessary disturbances in wind-flow and therefore prevents the creation of wind induced self-noise.

The acoustic sensor further includes a plurality of sound ports 18 extending through the housing 16. Preferably, the sound ports 18 are uniformly spaced along several circumferences centered about the longitudinal axis 14. The diameters of these sound ports 18 are in excess of ten times smaller than the smallest sound wavelength to be detected. In addition to the sound ports 18, the sound may also enter the housing 16 through deformation within the regions 16A that are sufficiently thin and pliant. Both acoustic signals and wind related, random-like pressure fluctuations are transmitted through the sound ports 18 and the housing 16A into an internal cavity 19 enclosed by the housing 16. The internal cavity 19 and the sound ports 18 together form a lumped element acoustic resonator. The housing 16 serves as a structural resonator that is coupled to the lumped element acoustic resonator. The housing 16 is designed such that combined resonance frequencies of the resonators are greater than the largest sound frequency to be detected. The sound ports 18 also aid in flattening the frequency response of the internal cavity 19. Addition of the acoustic signals and random-like pressure fluctuations from the sound ports 18 and the housing regions 16A occurs in the internal cavity 19 and the housing region 16A. Random-like pressures are removed upon addition owing to the statistical fact that there are as many negative random-like pressure fluctuations as there are positive random-like pressure fluctuations. Signal pressure contributions from the sound ports 18 and the housing regions 16A are roughly equal and therefore add together to form a larger pressure.

The acoustic sensor 10 further comprises a microphone 24 supported in place by a pair of microphone seats 22 to measure a signal in which the wind induced, random-like pressure fluctuations have been greatly reduced. The housing 16 may be secured to the ground or a flat surface by gripping the housing 16 from two adjacent edges or by inserting a rigid shaft into the center of the housing along the longitudinal axis 14.

Figure 4:
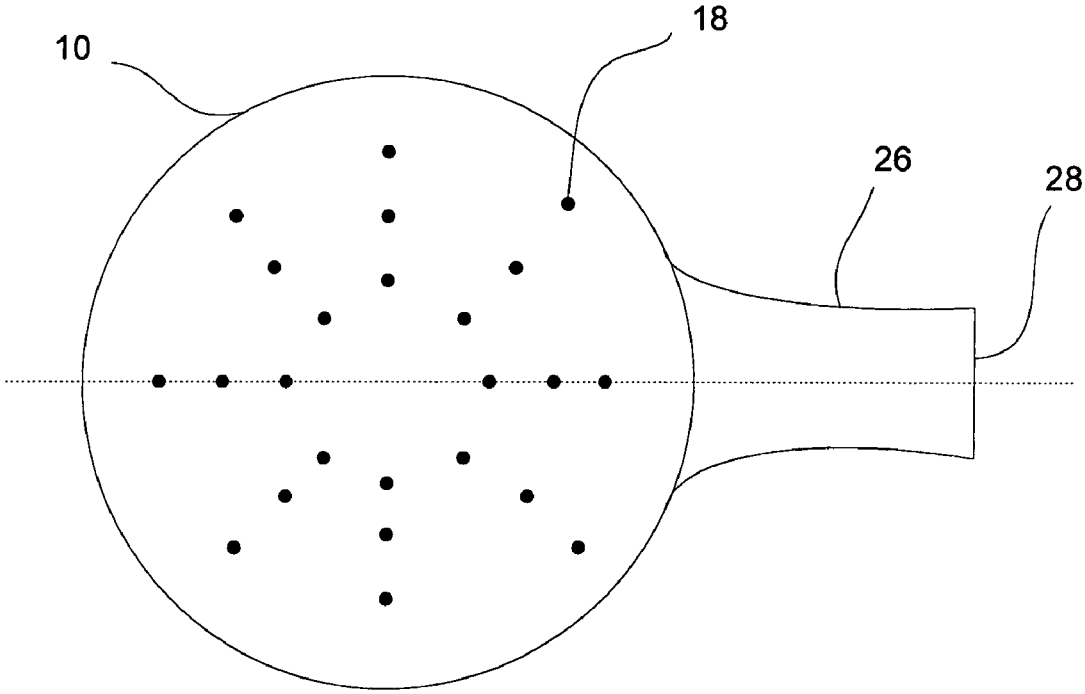
FIG. 4 is a variant of the microphone housing for forming the wind-shielded acoustic sensor.
Figure 5:
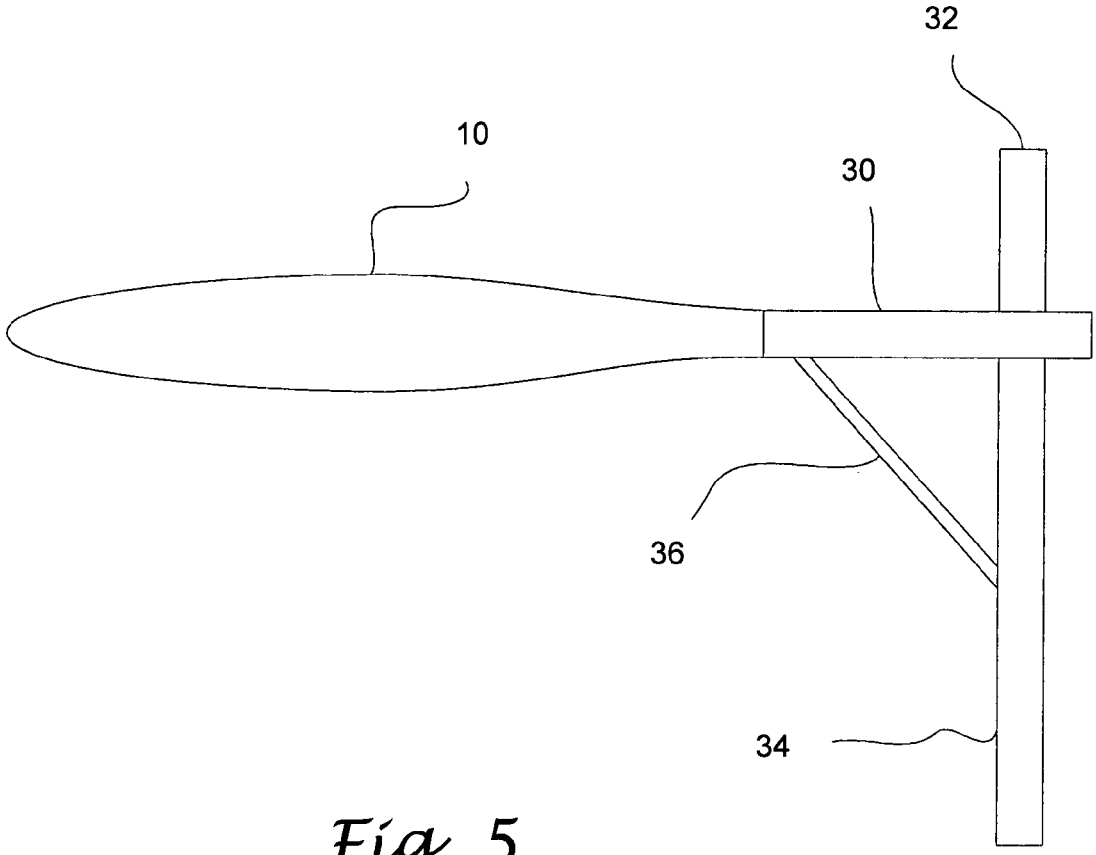
FIG. 5 shows the mounting scheme of the wind-shielded acoustic sensor as illustrated in FIG. 4.

An alternative configuration of the housing 16 is illustrated in FIG. 4. As shown, a streamlined surface 26 is extended from the circular disc of the housing and culminates in a mounting unit 28. FIG. 6 depicts a mounting scheme, which includes a shaft 30 to mate the mounting unit 28 and to extend towards a perpendicular shaft 32. To reduce vibrations, a cross-shaft 34 is fixed to the mated shaft 30 and the perpendicular shaft 32 in a diagonal manner.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art. For example, it should be understood that the acoustic sensor 10 can take any of a variety of aerodynamic shapes that are suited for a particular application and/or orientation relative an oncoming stream of wind. It should also be understood that the acoustic sensor 10 may be mounted in a number of different configurations, depending on the specific application for which the sensor is utilized. It is likewise contemplated that the acoustic sensors of the present invention may be utilized in any and all relevant applications known in the art, as well as utilized with all known and later developed signal processing technologies, such as frequency filters, noise cancellation and the like. Accordingly the invention and its application should be construed as broadly as possible.

What is claimed is:

1. A wind-shielded acoustic sensor configured to detect an acoustic signal, the acoustic sensor being disposable within a fluid flow generating random pressure fluctuations, the wind-shield acoustic sensor comprising:

a housing having a streamlined, aerodynamic profile, the housing defining a hollow internal cavity, the housing including at least one thin and pliable region configured to deform in response to the random pressure fluctuations, the housing being configured to average the random pressure fluctuations to substantially remove the random pressure fluctuations; and a sensor disposed within said internal cavity, the sensor being configured to detect the acoustic signal.

2. The acoustic sensor of claim 1, wherein the profile of the housing shell is symmetric about a longitudinal axis, the longitudinal axis being disposable perpendicular to the fluid flow.

3. The acoustic sensor of claim 1, wherein the profile of the housing shell is in the shape of a circular disc concentrically disposed about a longitudinal axis, the longitudinal axis being disposable perpendicular to the fluid flow.

4. The acoustic sensor of claim 3, wherein the housing shell further comprises a streamlined surface extending laterally from the circular disc.

5. The acoustic sensor of claim 4, wherein the streamlined surface culminates in a mounting unit.

6. The acoustic sensor of claim 5, further comprising a first shaft for mating the mounting unit, the first shaft extending radially from the sensor.

7. The acoustic sensor of claim 6, further comprising a second shaft perpendicular to and connected to the first shaft to space turbulence created by the second shaft away from the housing.

8. The acoustic sensor of claim 7, further comprising a cross shaft diagonally affixed to both the first and second shafts to enhance rigidity and mitigate turbulence formation.

9. The acoustic sensor of claim 1, further comprising a plurality of sound ports extending through the housing shell and into the interior cavity.

10. The acoustic sensor of claim 9, wherein the sound ports have a diameter in excess of ten times smaller than a smallest sound wavelength to be detected.

11. The acoustic tensor of claim 9, wherein the sound ports are uniformly spaced along a plurality of circumferences centered about a longitudinal axis of the housing.

12. The acoustic tensor of claim 9, wherein the sound ports and the internal cavity form a lumped element acoustic resonator.

13. The acoustic sensor of claim 12, wherein the resonator has a resonance frequency greater than a largest sound frequency to be detected.

14. The acoustic sensor of claim 1, further comprising a pair of microphone seats for supporting the microphone within the internal cavity.

15. The acoustic sensor of claim 1, further comprising a shaft inserted through a center of the housing shell along a longitudinal axis thereof.

16. A method of reducing wind-related noise associated with random pressure fluctuations for an acoustic signal to be detected, comprising:

(a) providing a microphone to detect the acoustic signal;

(b) forming a housing defining a hollow cavity, the housing being configured to deform in response to the random pressure fluctuations to average the random pressure fluctuations to substantially remove the random pressure fluctuations and disposing the microphone in the hollow cavity, said microphone being directly exposed to the ambient environment; and (c) removing wind-related noise pressure by adding negative components and positive components of the wind-related noise pressure fluctuations.

17. The method of claim 16, wherein step (c) includes forming a plurality of sound ports along a plurality of circumferences of the housing shell centered about a longitudinal axis thereof, each sound port extending through said housing shell and into said hollow cavity.

18. The method of claim 17, wherein the sound ports have a diameter ten times smaller than a smallest sound wavelength to be detected.

19. The method of claim 16, wherein the housing shell is so designed that combined resonance frequencies of the resonator are greater than a largest sound frequency to be detected.

* * * * *

UNITED STATES PATENT AND TRADEMARK OFFICE

CERTIFICATE OF CORRECTION

PATENT NO. : 7,916,887 B2
APPLICATION NO. : 11/035367
DATED : March 29, 2011
INVENTOR(S) : Jay Cleckler et al.

It is certified that error appears in the above-identified patent and that said Letters Patent is hereby corrected as shown below:

Please correct typographical errors in Claim 11 and Claim 12 as follows:

In Claim 11, please delete the word “tensor” and insert the word --sensor--.

In Claim 12, please delete the word “tensor” and insert the word --sensor--.

Signed and Sealed this
Second Day of October, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,916,887 B2
APPLICATION NO. : 11/035367
DATED : March 29, 2011
INVENTOR(S) : Jay Cleckler et al.

It is certified that error appears in the above-identified patent and that said Letters Patent is hereby corrected as shown below:

Please correct typographical errors in Claim 11 and Claim 12 as follows:

Column 4, line 45 (Claim 11, line 1), please delete the word "tensor" and insert the word --sensor--.

Column 4, line 48 (Claim 12, line 1), please delete the word "tensor" and insert the word --sensor--.

This certificate supersedes the Certificate of Correction issued October 2, 2012.

Signed and Sealed this
Sixth Day of November, 2012

David J. Kappos

David J. Kappos
*Director of the United States Patent and Trademark Office*